United States Patent [19]

Micoud et al.

[11] Patent Number: 4,916,268

[45] Date of Patent: Apr. 10, 1990

[54] OPERATING MECHANISM OF A THREE-POSITION SWITCH

[75] Inventors: Robert Micoud, Le Fontanil; Jacques Vernay, Grenoble, both of France

[73] Assignee: Merlin Gerin, France

[21] Appl. No.: 168,949

[22] Filed: Mar. 16, 1988

[30] Foreign Application Priority Data

Mar. 27, 1987 [FR] France ..... 87 04658

[51] Int. Cl.[4] ..... H01H 5/06

[52] U.S. Cl. ..... 200/400

[58] Field of Search ..... 200/153 SC, 400, 401, 200/457

[56] References Cited

U.S. PATENT DOCUMENTS 4,616,118 10/1986 Gasnier et al. ..... 200/153 SC

FOREIGN PATENT DOCUMENTS 0058585 8/1982 European Pat. Off. .

2181436 12/1973 France .

*Primary Examiner*—Renee S. Luebke

*Attorney, Agent, or Firm*—Arnold, White & Durkee

[57] ABSTRACT

An operating mechanism of a three-position switch comprises a tumbler device with an energy storage spring associated with a toggle, a main operating crank controlled by a switching shaft, and an earthing crank mounted in rotation on a first operating spindle. Opening and closing are performed by means of a second operating spindle, offset from the operating shaft and operating in conjunction with a transmission system designed to drive the toggle. A latching lever of the main crank is unlocked by a boss when the toggle is in the vicinity of the dead-point.

6 Claims, 5 Drawing Sheets

OPERATING MECHANISM OF A THREE-POSITION SWITCH

BACKGROUND OF THE INVENTION

The invention relates to an operating mechanism of a multipole switch capable of occupying three distinct stable positions, notably a first closed position, a second intermediate open position, and a third ground or earthed position, said mechanism being of the tumbler type comprising:

an energy storage spring associated with a toggle with highspeed dead-point overshoot, fitted with an actuating lever articulated on a spindle of a first operating crank, a main operating crank fixed on a rotating shaft securedly fixed to the movable assembly of the switch, an earthing crank mounted with limited rotation on a first operating spindle between an inactive position when the main crank is moved by the toggle between the closed and open positions, and an active earthed position causing the bearing point and the line of action of the spring to be modified resulting in further rotation of the main crank beyond the open position to the earthed position, and locking means of the main crank in each of the three positions of the switch.

A known mechanism includes a single energy storage spring which is described in detail in French Patent No. 2,500,222 filed by the applicant (and having an English language equivalent as European Patent 58,585). A single energy storage spring is sufficient to actuate the switch in one of the three positions. The opening and closing operating spindle is formed by the shaft of the movable assembly drive lever operating cam. The toggle actuating lever is arranged between the operating cam shaft, and the earthing crank operating spindle. This results in a lateral protrusion of the operating lever when it is engaged on one of the two operating spindles. The operating cam is unlocked after the toggle dead-point has been overshot due to the reactive force of a ramp on a block of a spring-mounted retaining crank. The ramp and springmounted retaining crank assembly does not provide positive latching of the cam, since unlocking takes place when the driving torque of the cam actuated by the toggle outweighs the resisting torque of the retaining crank.

The object of the invention is to achieve a compact operating mechanism, with positive latching of the operating crank.

SUMMARY OF THE INVENTION

The mechanism according to the invention is characterized in that a second spindle controlling opening and closing of the mechanism is offset from the operating shaft and operates in conjunction with a transmission system capable of driving the first toggle operating crank in rotation. In addition, a latching lever of the main crank is automatically actuated to an unlocked position when the toggle is in the vicinity of the dead-point.

The latching lever is advantageously unlatched by the mechanical action of a boss situated on the first crank of the toggle, unlocking taking place when the line of action of the spring is placed in alignment with the operating shaft and the pivoting spindle of the toggle. The energy stored in the spring actuating the mechanism is at its maximum at this moment when the main crank is unlocked.

The transmission system of the opening and closing operating movements of the second spindle comprises a rod articulated on a second transmission crank capable of operating in conjunction with a drive block of the first toggle crank. The second crank of the transmission system is coaxially mounted on the shaft with the first toggle crank.

The position of the switch contacts is indicated by means of an indicator fixed directly onto the operating shaft.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 2:
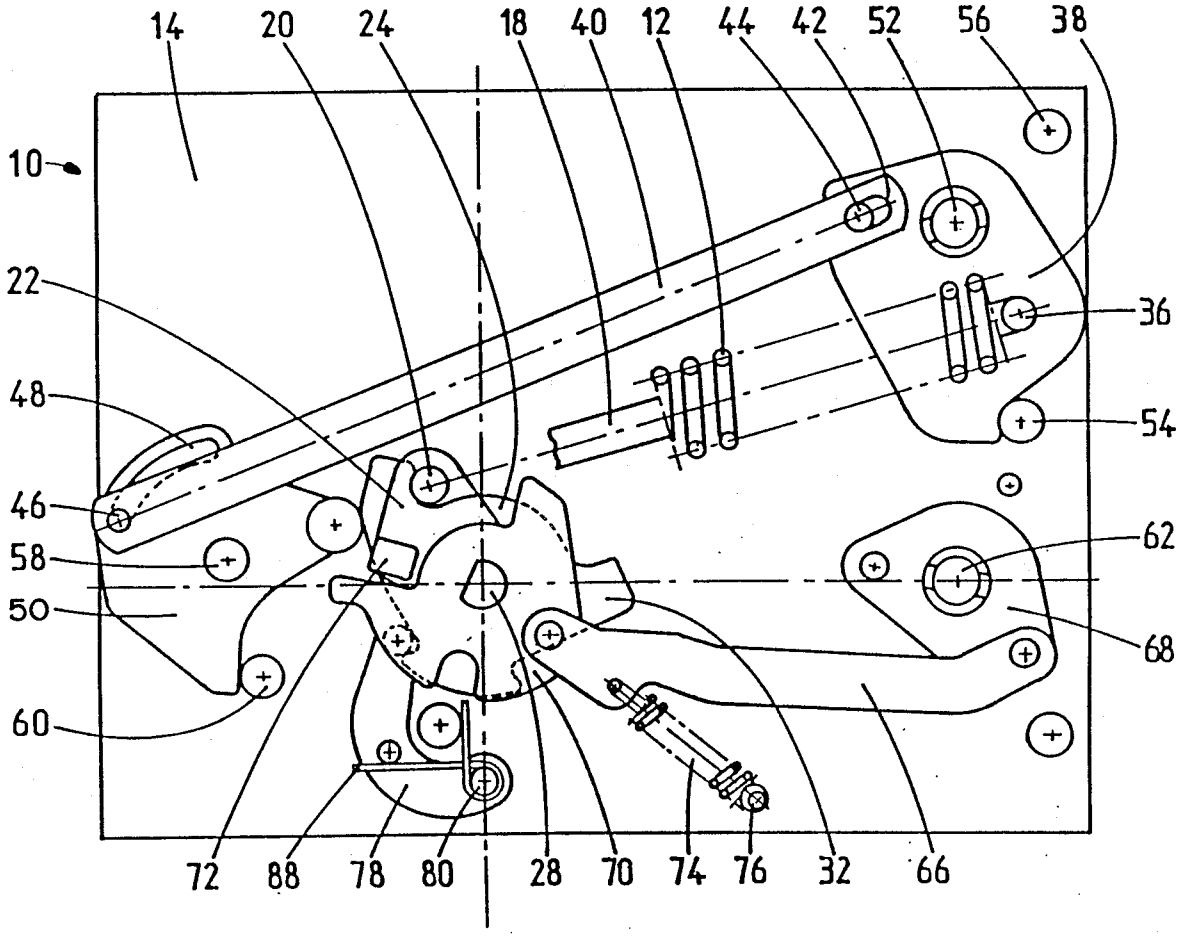
FIGS. 2 and 3 are identical views to FIG. 1, respectively in the open position O, and the earthed or grounded position T.
Figure 3:
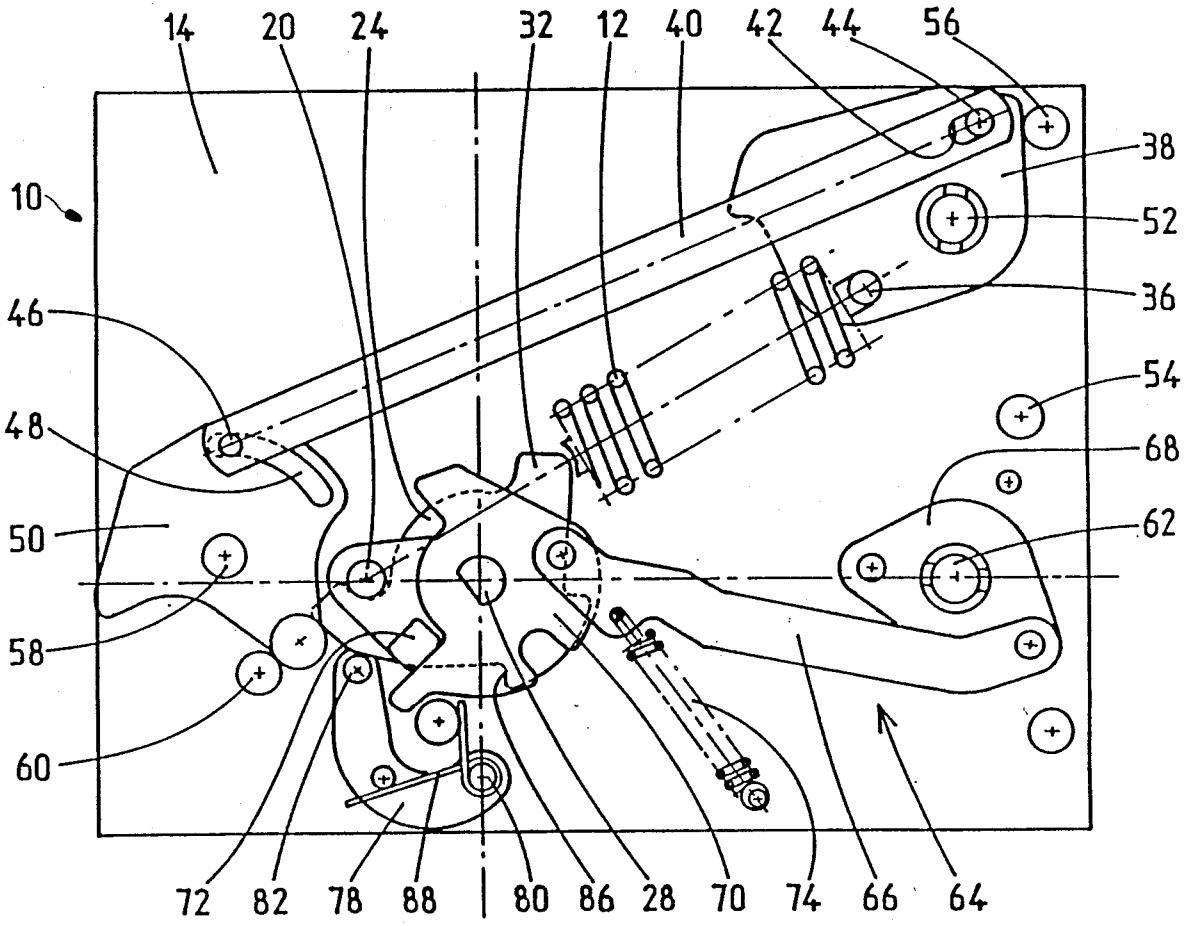

In the figures an operating mechanism 10 with an energy storage spring 12 is housed between a pair of support plates 14, and actuates a multipole electrical switch incorporated in a switching cubicle. The switch is electically connected between a busbar and connecting cables (not shown), and can occupy three distinct positions, notably a first operating position F by closing of the contacts (FIG. 1), a second intermediate insulation position O by opening of the contacts (FIG. 2), and a third cable grounding or earthing position T (FIG. 3).

The mechanism 10 is of the tumbler type with the energy storage spring 12 and high-speed dead-point overshoot by means of a toggle 16 comprising an actuating lever 18 articulated on a spindle 20 of a first operating crank 22. The spindle 20 of the toggle 16 operates in conjunction with a cam 24 forming part of a main operating crank 26 secured on a rotating shaft 28, fixedly united to the movable assembly of the different switch poles. The cam 24 presents a curved profile centered on the shaft 28 and bounded by two notches 30, 32, spaced apart constituting stops for the spindle 20 in each stable position of the toggle 16. The energy storage spring 12 is wound onto the lever 18, bearing on a fixed rib 34 of the latter, and a spindle 36 of an earthing operating crank 38.

The earthing operation by the crank 38 is performed by means of a transmission rod 40 one end of which comprises an oblong hole 42 in which a first crank pin 44 of the earthing crank 38 is engaged, and the opposite end of which bears a second crank pin 46 capable of moving in a curved groove 48. The curved groove 48 is arranged in an auxiliary locking crank 50 which stops the angular travel of the main crank 26 when the switch reaches the open O and earthed T positions.

The earthing crank 38 is fixedly united to a first rotating control spindle 52 which can be moved in rotation between the open O and earthed T positions. The angular travel of the crank 38 is limited by two stop blocks 54, 56. When the switch moves between the closed F and open O positions, the earthing crank 38 remains immobile bearing against the lower block 54.

The auxiliary locking crank 50 cooperates with a stop 60 and is mounted on a spindle 58 extending parallel to the operating shaft 28.

Operation of a three-position mechanism is described below.

According to the invention, the switch opening and closing operation is performed by means of an operating lever (not shown) engaged on a second operating shaft 62 offset from the operating shaft 28 of the poles. The operating movement is transmitted by means of a transmission system 64 comprising a rod 66 articulated at both ends, respectively on a third operating crank 68 keyed onto the rotating spindle 62, and on a second transmission crank 70 mounted with free rotation on the shaft 28.

The crank 22 of the toggle 16 is mounted loose on the shaft 28, and comprises a drive block 72 capable of cooperating with the transmission crank 70 on closing and opening of the switch. A return spring 74 attached between the rod 66 and a fixed point 76 biases the transmission system 64 to the open position O represented in FIG. 2.

Figure 1:
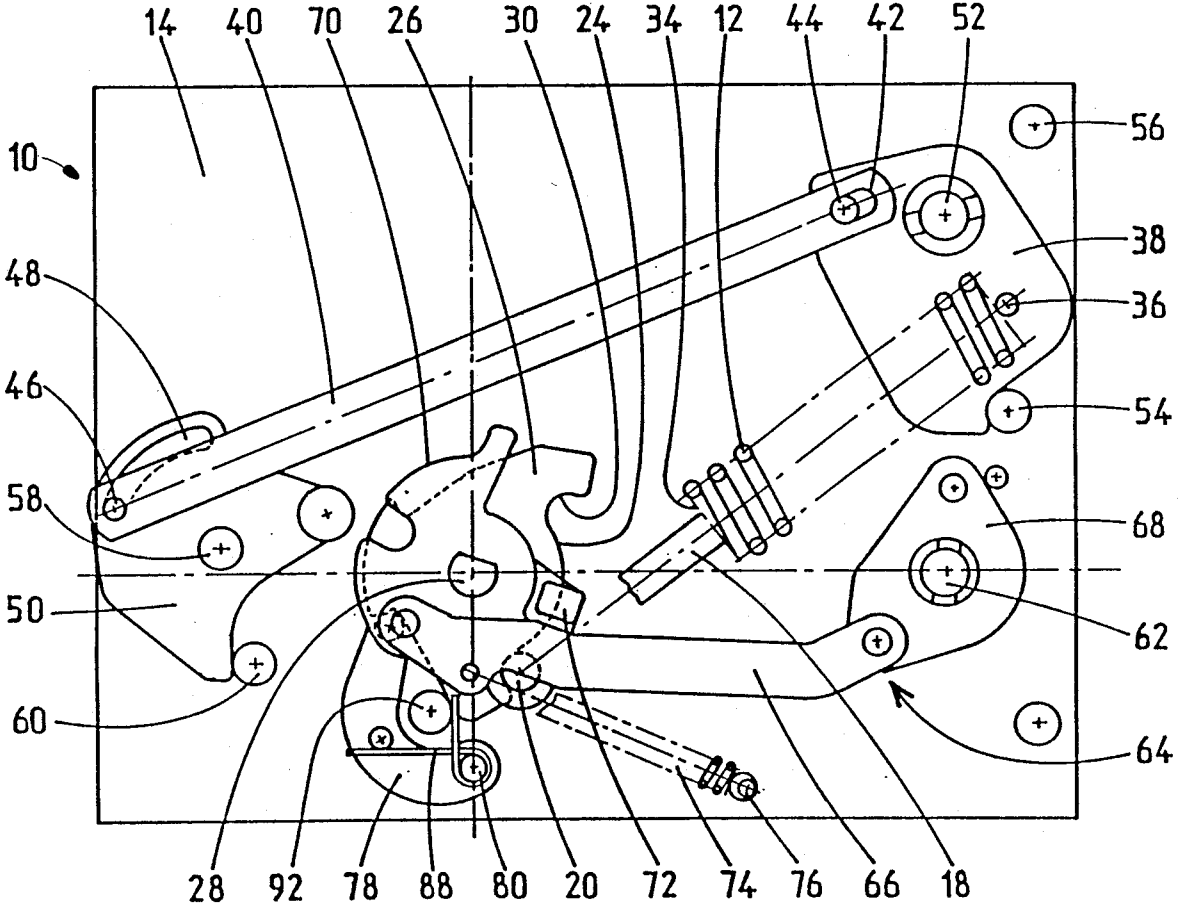
FIG. 1 is an elevational view of the mechanism according to the invention, corresponding to the closed position F of the switch.
Figure 4:
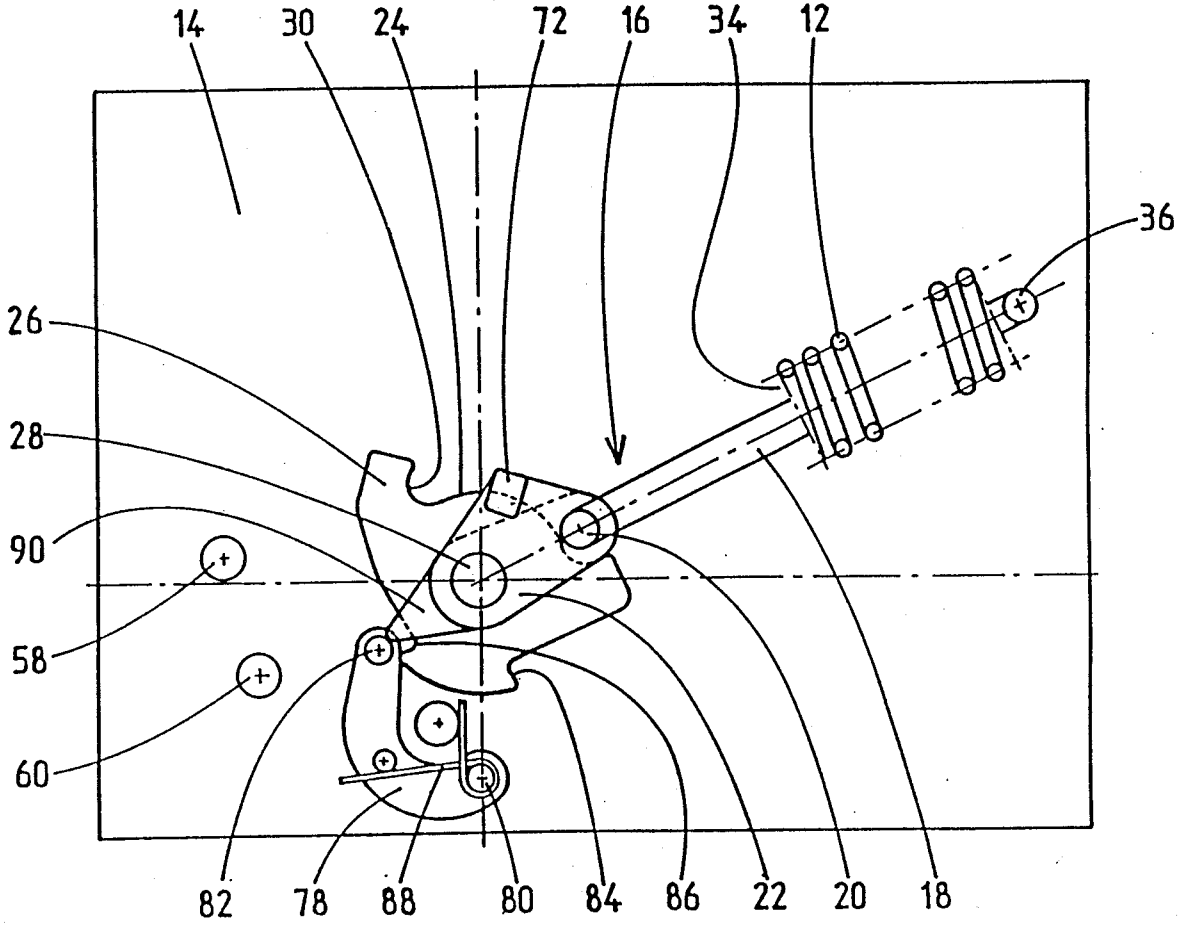
FIG. 4 shows a partial view of the mechanism when the latching lever is unlocked during switching from the open position O to the closed position F.

A latching lever 78 is pivotally mounted on a spindle 80 between a locked position and an unlocked position, and comprises a retaining pin 82 designed to clip in the locked position onto a ledge 84, 86 of the main operating crank 26. A torsion spring 88 is inserted on the spindle 80 and biases the latching lever 78 to the locked position (FIGS. 1 and 2). The presence of the lever 78 provides latching of the main crank 26 in the locked position before the dead-point of the toggle 16 is overshot which occurs during the opening and closing travel. Releasing the crank 26 by unlocking the lever 78 takes place automatically in the vicinity of the dead-point overshoot due to the action of a boss 90 (FIG. 4) belonging to the crank 22 of the toggle 16.

An indicator (not shown) is fixed directly onto the operating shaft 28, so as to indicate the actual position of the switch contacts.

Operation of the switch mechanism 10 according to the invention is as follows:

CLOSED POSITION F (FIGS. 1 AND 5)

The main operating crank 26 is resting stably against a stop 92, and is locked in this position by the latching lever 78 whose pin 82 blocks the ledge 84 preventing the main crank 26 from rotating counterclockwise. The pivoting spindle 20 of the toggle 16 is positioned in the notch 32 of the cam 24, and the earthing crank 38 is held against the lower stop block 54 by the action of the spring 12.

SWITCH OPENING

Figure 5:
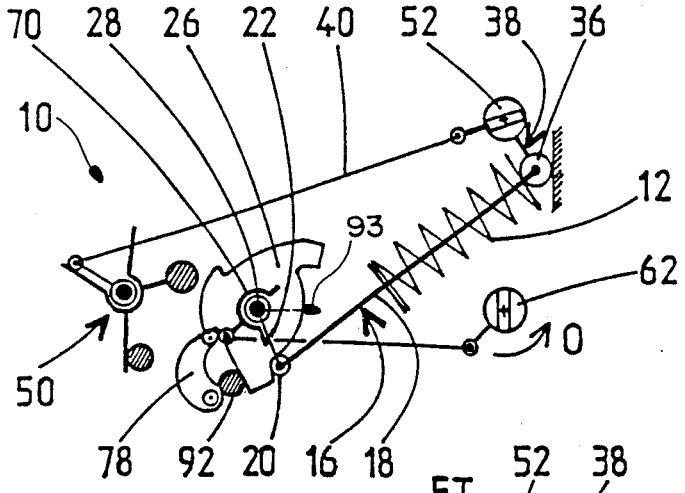
FIGS. 5 to 7 represent simplified diagrams of the mechanism according to the respective positions of FIGS. 1 to 3.
Figure 6:
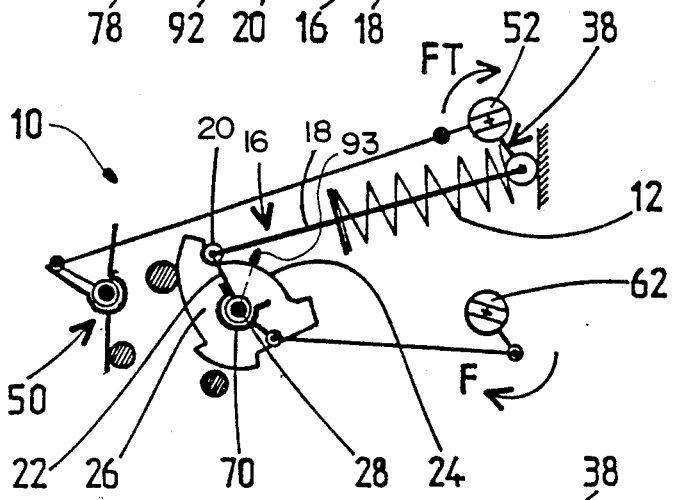

From the closed position F, opening of the switch takes place by engaging an operating lever on the spindle 62, followed by counterclockwise rotation of the crank 68 is indicated by the arrow O (FIG. 5). The transmission system 64 moves the transmission crank 70 counterclockwise, which drives the block 72 of the crank 22 of the toggle 16 in the same direction. The pivoting spindle 20 of the toggle 16 moves up along the cam 24, whereas the main crank 26 remains locked in the position in FIG. 1 by the locking action of the latching lever 78. When the spindle 20 of the toggle 16 reaches the instable position aligned with the spindle 36 and the shaft 28, the spring 12 is fully compressed, and the boss 90 of the crank 22 pushes the latching lever 78 to the unlocked position, against the return force of the spring 88, causing the main crank 26 to be released. Overshooting the dead-point drives the spindle 20 of the toggle 16 towards the notch 30 of the cam 24, followed by the energy storage spring 12 being released, and high-speed rocking of the main crank 26 to the open position O (FIGS. 2 and 6). In this position, the main crank 26 comes up against the auxiliary locking crank 50, and the latching lever 78 returns to the locked position by the pin 82 clipping onto the ledge 84. This results in positive latching of the mechanism 10 in the open position.

SWITCH RECLOSING

Switching from the open position O (FIG. 2) to the closed position F (FIG. 1) is performed manually by means of the lever by clockwise rotation of the operating crank 68, as indicated by the arrow F in FIG. 6. When the toggle 16 reaches the dead-point (FIG. 4), the latching lever 78 is unlocked by the boss 90 of the crank 22. The spindle 20 overshooting the dead-point and the spring 12 being released then causes clockwise rotation of the main crank 26, and high-speed closing of the switch. The mechanism 10 then returns to the position indicated in FIGS. 1 and 5.

The cranks 38 and 50 of the connecting rod 40 do not move during the opening and closing movements of the mechanism 10. The offset of the operating shaft 62 with respect to the movable assembly operating shaft 28 avoids any lateral protrusion of the operating lever. Closing and opening of the switch by unlocking the latching lever 78 of the tumbler mechanism 10 takes place at precise moments when the energy stored in the energy storage spring is at its maximum.

EARTHING OPERATION

Earthing or grounding of the contacts is performed from the open position O (FIGS. 2 and 6) by clockwise actuation of the operating spindle 52 of the crank 38, as indicated by the arrow FT in FIG. 6. The lever 78 remains inactive during this operating phase, and allows the

Figure 7:
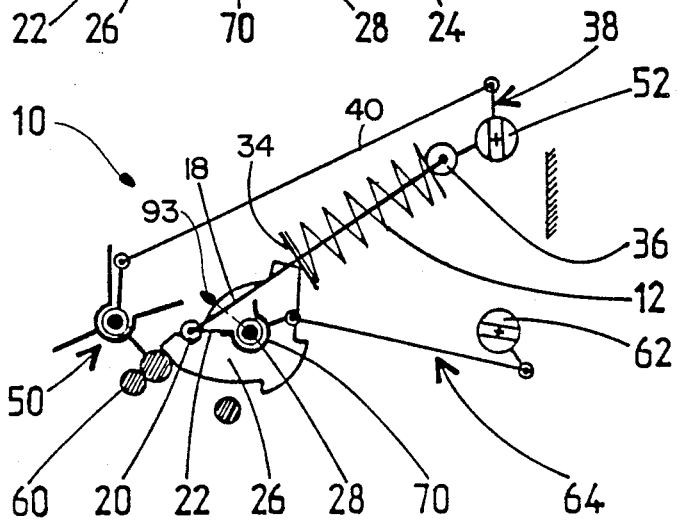

We claim: main crank 26 to rock to the position T (FIGS. 3 and 7).

1. An operating mechanism of a multipole switch having a movable assembly capable of occupying three distinct stable positions, notably a first closed position (F), a second intermediate open position (O), and a third grounded position (T), said mechanism (10) comprising:

an energy storage spring (12) associated with a toggle (16) having a high-speed dead-point overshoot, the toggle (16) beign fitted with an actuating lever (18) articulated on a spindle (20) of a first operating crank (22) for changing a line of action of said energy storage spring (12), a main operating crank (26) fixed on a rotating shaft (28) which actuates the movable assembly of the switch, a grounding crank (38) mounted with limited rotation on a first operating spindle (52) between an inactive position when the main crank (26) is moved by the toggle (16) between the closed (F) and open (O)

positions, and an active grounded position causing the line of action of the energy storage spring (12) to be modified resulting in further rotation of the main crank (26) beyond the open position (O) to the grounded position (T), a second operating spindle (62) for controlling opening and closing of the switch, said spindle (62) being offset from the rotating shaft (28) and cooperating with a transmission system (64) capable of driving the first operating crank (22) of the toggle (16) in rotation, and locking means for locking the main crank 26 in each of three positions (F, O, T) of the switch, said locking means including a latching lever (78) cooperating with the main crank (26), said lever being automatically actuated to an unlocked position when the toggle (16) is near the dead-point.

2. An operating mechanism according to claim 1, wherein the first operating crank (22) of the toggle (16) comprises a boss (90) designed to unlock the latching lever (78) against the opposite force of a return spring (88), when the line of action of the energy storage spring (12) is placed in alignment with the axis of the rotating shaft (28) and the spindle (20) of the first operating crank (22).

3. An operating mechanism according to claim 1, wherein the pivoting spindle (20) of the first operating crank 22 moves along a cam (24) of the main crank (26) when the latching lever (78) is in the locked position, the first operating crank (22) of the toggle (16) being mounted with free rotation on the rotating shaft (28).

4. An operating mechanism according to claim 3, wherein the transmission system (64) of the opening and closing movements of the second operating spindle (62) comprises a rod (66) articulated on a second transmission crank (70) cooperating with a drive block (72) of the first operating crank (22).

5. An operating mechanism according to claim 4, wherein the second transmission crank (70) is coaxially mounted on the rotating shaft (28) together with the first operating crank (22).

6. An operating mechanism according to claim 4, wherein the energy storage spring (12) is mounted on the actuating lever (18) of the toggle (16), and is located in an interval arranged between the first operating spindle (52) of the grounding crank (38), and the rod (66) of the transmission system (64), said rod (66) being coupled to a third operating crank (68) keyed onto the second operating spindle (62).

* * * * *